United States Patent [19]

Lee et al.

[11] 4,269,117

[45] May 26, 1981

[54] ELECTRO-MAGNETIC PRINT HAMMER

[75] Inventors: Ho C. Lee, Endicott; David H. Rickenbach, Chenango Forks; Jack L. Zable, Vestal, all of N.Y.

[73] Assignee: International Business Machines Corporation, Armonk, N.Y.

[21] Appl. No.: 56,486

[22] Filed: Jul. 11, 1979

[51] Int. Cl.[3] ..... B41J 9/42

[52] U.S. Cl. ..... 101/93.02; 101/93.48

[58] Field of Search ..... 101/93.02, 93.04, 93.05, 101/93.14, 93.29, 93.30, 93.33, 93.34, 93.48, 111

[56] References Cited

U.S. PATENT DOCUMENTS

| | | | |
|---|---|---|---|
| 3,195,453 | 7/1965 | Thiemann | 101/93 |
| 3,266,418 | 8/1966 | Russo | 101/93.02 |
| 3,513,773 | 5/1970 | Ponzano | 101/93.33 |
| 3,714,892 | 2/1973 | Perry | 101/93 |
| 3,741,113 | 6/1973 | Mako et al. | 101/93.02 |
| 3,747,521 | 7/1973 | Hamilton et al. | 101/93.14 |
| 3,919,933 | 11/1975 | Potter | 101/93.02 X |

OTHER PUBLICATIONS

Engel et al., IBM Tech. Discl. Bulletin, vol. 15, No. 3, p. 916, Aug. 1972.

Mathews, IBM Tech. Disclo. Bulletin, vol. 19, No. 9, pp. 3245-3246, Feb., 1977.

Gilbert et al., IBM Tech. Discl. Bulletin, vol. 17, No. 3, pp. 780-781, Aug., 1974.

Mulzet et al., IBM Tech. Discl. Bulletin, vol. 16, No. 11, pp. 3529-3531, Apr., 1974.

*Primary Examiner*—Edward M. Coven

*Attorney, Agent, or Firm*—John S. Gasper

[57] ABSTRACT

An electro-magnetic print hammer comprises a single magnetic hammer element in which an impact mass is coupled to a pivotted armature by flexible stem. The hammer-stem has $(N+\frac{1}{2})$ periods of oscillation at its resonant frequency during the free flight time of the hammer mass. A permanent magnet with a strong magnetic force which decays rapidly with distance holds the hammer element fixed upon motion of the armature until the armature torque exceeds the magnet holding force to cause the hammer mass to break loose with a snap action. Stop means prevents armature impacts with the operating pole piece of a stator core. The visco-elasticity of the armature stop matches the rebound characteristics of the print medium when impacted by the hammer mass.

3 Claims, 7 Drawing Figures

ELECTRO-MAGNETIC PRINT HAMMER

BACKGROUND OF THE INVENTION

1. Field of Invention

This invention relates to printing and particularly to print hammer devices for use in high speed printing apparatus.

2. Description of Prior Art

Print hammer devices have heretofore comprised a pivoted single print hammer element in which the armature or yoke of an electro-magnetic actuator and the hammer portion are structurally combined. In some cases the armature and hammer are made as an integral single piece so as to reduce cost and simplify manufacture. Examples of such print hammer devices are described in the following U.S. Pat. Nos. 3,177,803—Antonucci; 3,200,739—Antonucci; 3,349,696—Potter; 3,513,773—Ponzano; 3,705,370—Chai, et al.; 3,711,804—Kroft, et al.; 3,714,892—Perry; 3,747,521—Hamilton, et al.; and the following publications; IBM Technical Disclosure Bulletin, pages 3529–31, Vol. 16, #11, dated April, 1974 and pages 780–81 of Vol. 17, #3, dated August, 1974.

All of the above references are concerned with short contact or dwell time and/or elimination of double impact, both of which degrade the quality of printing produced in high speed printer apparatus. A common solution proposed by the prior art for essentially rigid hammer elements is to use, an elastic stop member in the vicinity of the hammer head or stem portion of the hammer or a return spring or both as described in the Antonucci and Potter patents, a permanent restore magnet as described in the patents of Kroft et al. and Chai et al., or to lump mass at critical positions relative to the impact point as disclosed in the referenced publications.

Another solution proposed by the patents of Hamilton et al., Ponzano and Perry is to provide an elastic hammer element in which the hammer portion continues to move after the armature is abruptly stopped by contact with the pole pieces of the electro-magnet.

While the above described structures provide means to obtain good print quality at relatively high speeds, certain difficulties arise when the print speeds are to be further increased. The rigid hammer structures are essentially too heavy to have a short enough contact time and require high energy. Energy which can be used for printing is lost to return springs or penetration bars. Likewise, in the elastically deformable hammer substantial energy is lost to the elastic deformation prior to impact. Furthermore, impact of the armature on the residual or pole piece in the operating air gap of the electro-magnet over a period of time causes degradation of the visco-elastic and non-magnetic properties of the material. This eventually produces erratic operation for the hammers thereby affecting print quality. It is also difficult to find materials in which the non-magnetic properties and visco-elasticity of the residual are the most desirable to fulfill both functions for rebounding the armature, etc.

SUMMARY OF THE INVENTION

It is a general object of the invention to provide an improved print hammer mechanism.

It is a futher object of this invention to provide an improved print hammer mechanism of the type in which an armature and an impact or hammer head are combined into a single movable element.

It is a further object of this invention to provide an improved hammer mechanism capable of use in printers for printing at increased print rates.

It is a still further object of this invention to provide an improved hammer mechanism in which maximum impact energy can be delivered to the print medium.

It is another object of this invention to provide print hammer mechanism in which contact time is very short and in which double impacts are eliminated.

It is a still further object of this invention to provide a hammer mechanism which is simple to manufacture which can be mass-produced with precision and which will have long-lasting reliability in operation.

Essentially, the above as well as other objects are achieved by providing a hammer device in which the pivoted hammer element comprises an impact or hammer head joined to a relatively rigid pivotable armature by a flexible stem or extension. In the preferred embodiment the hammer head, stem, and armature are fabricated as an integral single piece from a magnetic material.

An electro-magnet for operating the hammer element comprises a core which forms an operating air gap with the armature and a coil which when energized creates the magnetic force at the air gap for attracting the armature. The hammer rotates at a pivot axis and the impact mass accelerates in free flight to the print medium. In accordance with this invention the stem is made flexible so that the hammer head carried by it follows the armature in a delayed fashion. In addition the stem flexibility is such that it allows the hammer head to oscillate relative to the armature during the flight from the position of rest to the point of impact with the print medium. In the preferred embodiment, flexibility of the stem is such that there are $(N+\frac{1}{2})$ periods of oscillation of the hammer head and stem at its resonant frequency during the flight time. N is an integer and preferably is 0 or 1. With this flexure characteristic the hammer head will always be able to impact the print medium at maximum velocity.

It is a further feature of this invention to provide means for holding the impact mass at the position of rest for a controlled time interval following energization of the electro-magnet with a force which causes the stem to flex an added amount. The holding means is preferably a permanent magnet with a strong magnetic force of attraction which decays rapidly with distance. When the torque applied to the armature by the electro-magnet exceeds the holding force of the permanent magnet the flexible stem breaks loose with a snap action.

An additional feature of this invention includes providing a stop means which prevents damage to magnetic structure of the air gap of the operating magnet. For this purpose, the armature is provided in the preferred form of the invention with a rigid spur or stop extension which operates to engage a fixed stop member located in the path of movement of the spur. The stop mechanism is placed relative to the armature such that the armature is stopped concurrently with or slightly ahead of the impact of the hammer mass and the print medium. In a second embodiment the stop mechanism comprises the passive pole of the electro-magnet core. In either case a stop pad can be used on the stop member to engage the armature or its stop extension. In either case the stop pad is selected to have visco-elastic properties which substantially match the rebound properties of the print medium. With the stop means located to arrest the motion of the armature at the beginning of impact between the hammer head and the print medium, the hammer rebounds and reverses direction. Due to the flexibility of the stem the hammer head may move forward slightly on penetration of the print medium, while the armature reverses direction and before the hammer head reverses its direction on rebound. In that event the hammer head catches up with the armature and moves away from the print medium thereby eliminating a chance for double impacts. The hammer head-print medium impact time is also minimized. Where the stop pad and print medium have matched rebound properties, the hammer head and armature rebound substantially together to prevent double impacts. With the armature motion leading the hammer head in reverse direction, the armature helps shortening the contact time of the hammer.

The foregoing and other objects, features and advantages of the invention will be apparent from the following more particular description of preferred embodiments of the invention, as illustrated in the accompanying drawings.

DETAILED DESCRIPTION

Figure 1:
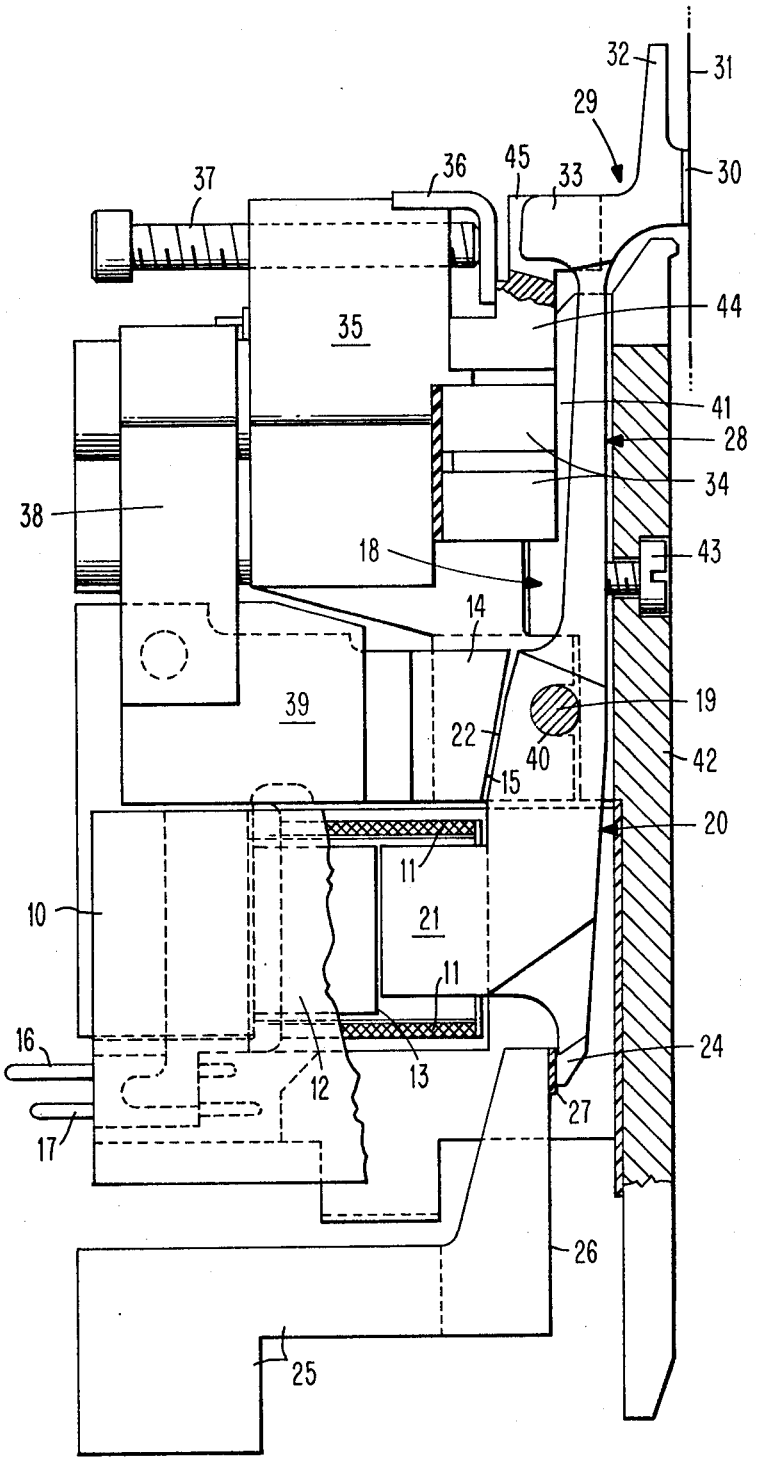
FIG. 1 is a side view of a print hammer unit assembly with some cross-sectioning which incorporates the invention.

Referring to FIG. 1 the basic print hammer unit of this invention comprises a U-shaped magnetic core 10. Operating winding 11 is positioned on lower leg 12 and extends beyond pole face 13 which forms an operating air gap. Upper leg 14 has pole face 15 slanted toward the end of operating winding 11. Terminals 16 and 17 for winding 11 provide the means for making an electrical connection to an external power source not shown.

The print hammer unit further comprises a hammer element 18 which is pivotally supported adjacent to pole face 15 of the upper leg 14 by pivot shaft 19. Armature 20 of hammer element 18 has a projection 21 in alignment with lower core leg 12 of core 10. Projection 21 is positioned substantially within winding 11 and coacts with pole face of lower leg 12 to form the operating air gap in such a manner that the air gap is completely within winding 11 during pivotal movement of armature 20. A second air gap is formed between edge 22 of armature 20 and slanted pole face 15 of upper leg 14. Edge 22 is slanted to obtain parallelism with pole face 15 at the forwardmost stroke of armature 20. Hole 40 (See FIG. 4) in the upper end of armature 20 receives pivot shaft 19. Spur extends from the bottom of armature 20 for making contact with an armature stop mechanism which preferably comprises stationary block 25 and arm 26. The armature stop is located to limit the clockwise rotation of armature 20 and cause it to rebound in a counterclockwise direction. Block 25 is positioned so that projection 21 of armature 20 does not crash against pole face 13 of lower leg 12 or any residual material not shown. A stop pad 27, of suitable material such as polyurethane is carried on the end of arm 26. Pad 27 is impacted by spur 24 when armature 20 rotates clockwise. It is desirable that pad 27 have a visco-elastic property substantially matching the rebound characteristics of the print medium 31. In that event armature 20 and the hammer head 29 will begin rebound at substantially the same time when impact with stop pad 27 and print medium 31 occur concurrently.

Extending upwardly from armature 20 is stem 28 which carries a hammer head 29. The forward end of hammer head 29 terminates in an impact face 30 for striking medium 31 against type characters on a carrier such as a belt not shown. The tab 32 above hammer face 30 distributes the mass of the hammer to make the center of the effective impact and stem mass more nearly coincident with the center of impact. This desensitizes the hammer to double impacts. Tail 33 behind hammer face 30 provides guidance for hammer head 29.

Stem 28 has a substantially reduced width compared to armature 20. Stem 28 is also tapered slightly from the point of armature 20 to the base of hammer head 29. Thus stem 28 is made flexible to allow bending about the pivot axis of armature 20. The amount and degree of flexure can vary depending upon the operating parameters of the hammer system.

In accordance with this invention the degree of flexibility is such that the impact mass (i.e. hammer head 29) follows the armature 20 in a delayed fashion and in addition oscillates relative to armature 20. The period of oscillation of the resonant frequency of the hammer-stem impact mass is chosen such that there are $N+\frac{1}{2}$ periods of oscillation during the free flight time. This assures that the impact mass will strike print medium 31 when hammer head 29 is travelling at its maximum velocity thereby delivering maximum energy for printing.

Figure 4:
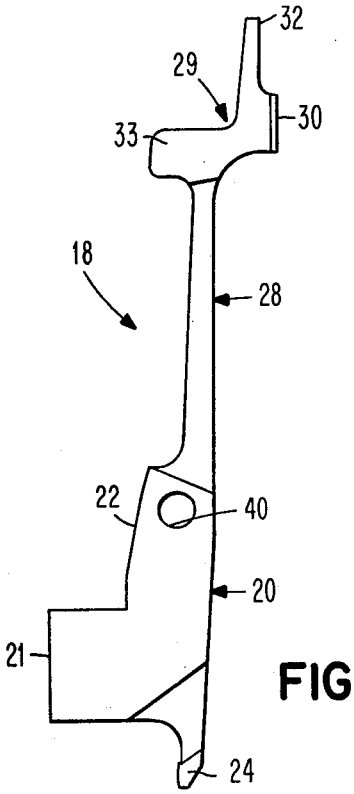
FIG. 4 is a side view of the hammer element of FIG. 1.
Figure 5:
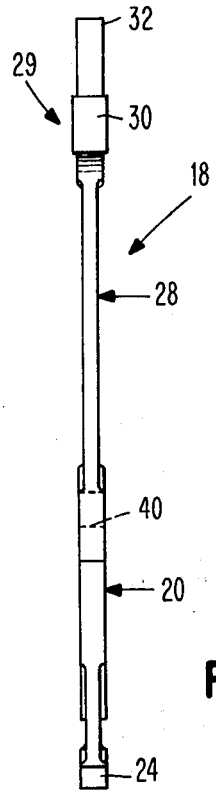
FIG. 5 is an edge view of the hammer element of FIG. 4 as viewed from the right.

As seen in FIGS. 4 and 5, hammer element 18 is fabricated from a single piece of magnetic material such as 8620 low carbon steel thereby providing a hammer element in which the hammer head 29, stem 28 and armature 20 are integral. As best seen in FIG. 5 stem 28 has a reduced thickness in addition to a reduced width compared to armature 20. This reduces the overall weight of hammer element 18 and affords added means to obtain the desired flexibility for stem 28 which will allow bending and hammer head motion independent of the armature mass 20.

This invention further includes a holding means in the form of a permanent magnet 34 attached to a fixed support bar 35. Preferably magnet 34 is located intermediate hammer head 29 and pivot shaft 19. Since stem 28 is magnetic, magnet 34 exerts a counterclockwise torque on hammer element 18 which opposes the clockwise torque developed on armature 20 when winding 11 is energized. When winding 11 is not energized, magnet 34 retains hammer element in a rest position in which stem 28 is not flexed. In the rest position pole face 13, lower leg 12 of core 10 and projection 21 of armature are separated by the maximum operating air gap. Stop spur 24 is separated from stop pad 27 on arm 26 of the stop block 25. Tail 33 of hammer head 29 will be in contact with upper stop 36 carried by adjustable screw 37 of support bar 35.

Figure 7:
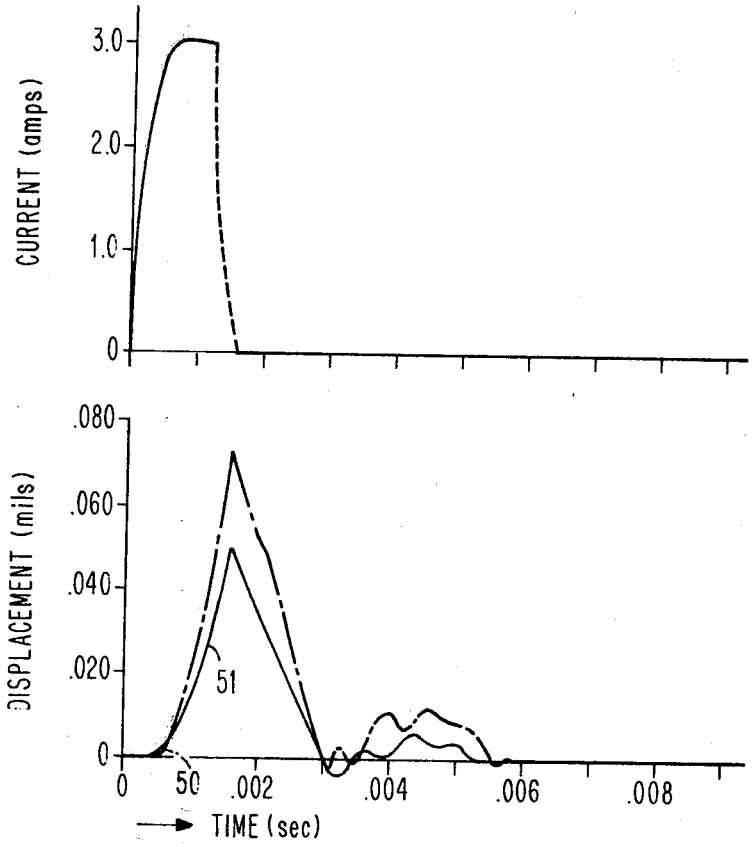
FIG. 7 is a timing chart showing the displacement of the impact portion and the armature of the print hammer element of FIG. 1 during a single cycle of operation.
Figure 6:
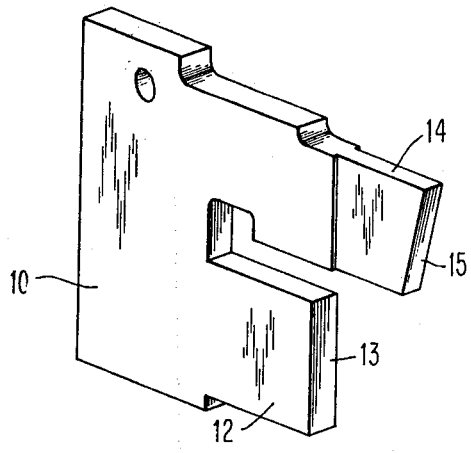
FIG. 6 is a three-dimensional view of a core member of the electro-magnet of FIG. 1.

In order to print with the described single element hammer unit, winding 11 is energized with a short time duration current pulse 46 (See FIG. 7). As the flux field builds up in the operating air gap projection 21 is attracted to lower leg 12 causing armature to move in a clockwise direction. Due to the holding force of permanent magnet 34 hammer head 29 does not begin moving immediately. Instead, while armature 20 moves ahead of hammer head 29 as shown by curves 50 and 51 in FIG. 7 stem 28 bends storing elastic energy. When the breakaway force reaches the holding force of permanent magnet 34, stem 28 and hammer head 29 break loose with a snap action and hammer head 29 accelerates in free flight for impact with print medium 31. During flight stem 28 and hammer head 29 oscillate at a predetermined resonant frequency. As previously mentioned, there are $(N+\frac{1}{2})$ periods of oscillation at the resonant frequency of the stem and hammer head during the flight time. Thus, hammer head 29 impacts print medium 31 at its maximum velocity. At the same instant stop spur 24 of the armature 20 impacts pad 27. On impact with pad 27 armature 20 rebounds and begins rotating counterclockwise. Since pad 27 has substantially the same visco-elastic properties of print medium 31, the rebound of armature 20 and hammer head occur at substantially the same instant. Without a perfect match of the visco-elastic properties of pad 27 and print medium 31, reversal may occur more or less at slightly different instants. Since stem 28 is flexible armature 20 and hammer head 29 move independently after impact. In some cases hammer head 29 may rebound slightly ahead of armature 20. In other instances, slightly later. In either situation, the armature 20 rebound is timed to occur before hammer head 29 can reverse direction after rebound to strike print medium 31 more than once. After rebound stem 28 returns to the rest position where it is held by permanent magnet 34 until a subsequent energizing pulse is applied to winding 11.

The specific set of dimensions and operating parameters for a hammer mechanism made in accordance with this invention is as follows:

Stem flexibility=250 lb/in.
Equivalent impact head mass=1.2 grams.
Pivot-head distance=1.38 in.
Pivot-armature distance=0.56 in.
Pivot-stop pad distance=0.97 in.
Pole face area=0.4 in.×0.08 in.
Max. coil ampere turns=1000 ampere turn.
Pulse-on time=1.2 ms.
Armature stop pad=90 durometer polyurethane.
Pad thickness=0.016 in.

Figure 2:
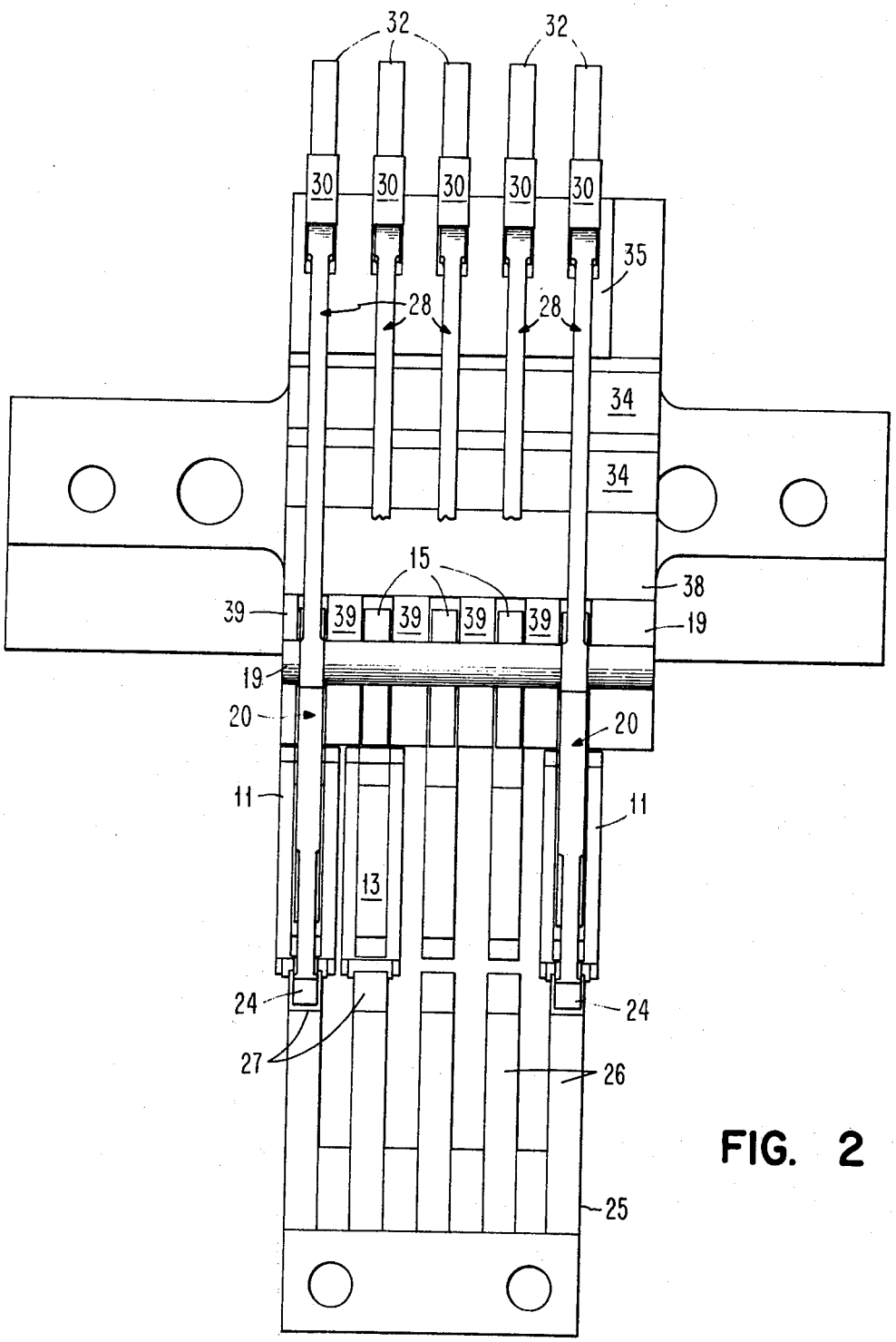
FIG. 2 is a front elevation of a multiple hammer unit incorporating the mechanisms of FIG. 1 with the cover plate removed.
Figure 3:
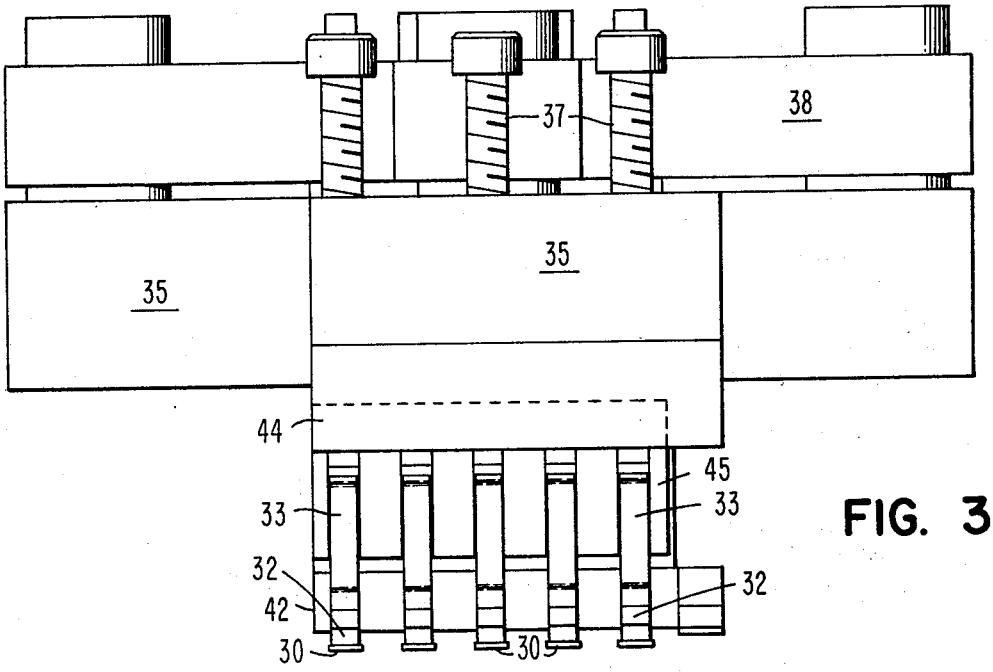
FIG. 3 is a top view of the print hammer unit of FIG. 2.

The preceding description essentially describes the invention as a single hammer unit for a single hammer element. The invention however is contemplated to be adaptable for multiple hammer assemblies. The description of a multiple hammer assembly now follows. As seen in FIGS. 1, 2 and 3 a stator support block 38 is provided for retaining plural (in this case 5) stator cores 10 in uniformly spaced relation. Support block 38 is preferably a molded plastic with stator cores 10 in place.

The spacing of stator cores 10 corresponds with a print position spacing of a line printer apparatus. At the bottom of support bar 35 support arms 39 are located between upper leg 14 of cores 10. Support arms 39 are made of non-magnetic material such as aluminum. Circular groove 40 in the support arms 39 form a recess 40 for pivot shaft 19. Vertical flanges 41 on cover plate 42, also of non-magnetic material, align with the support arms 39 and hold pivot shaft 19 in groove 40 when attached to block 35 by screws 43. Each hammer element 18 is thereby physically separated and magnetically isolated within the assembly. Upper guide bar 44 attached to support bar 35 has flanges 45 for guiding tail 33 during rotation of hammer element 18 on pivot shaft 19. Each multiple hammer assembly just described can be assembled as a single module to a support frame. Plural modules would be assembled in a linear fashion to provide a row of a large number of individually operable hammer elements 18 for printing lines of data.

While the invention has been particularly shown and described with reference to preferred embodiments thereof, it will be understood by those skilled in the art that the foregoing and other changes in form and details may be made therein without departing from the spirit and scope of the invention.

Having thus described my invention, what I claim as new, and desire to secure by Letters Patent is:

1. A print hammer device for use in a high speed printer comprising:

a single piece hammer element having a flexible stem portion integrally connected to an armature portion and an impact mass carried at the remote end of said stem portion, said stem and armature portions extending outwardly from a pivot axis through said armature portion, said armature portion being part of an electromagnetic circuit having an operating air gap made variable by pivotal movement of said armature portion on said axis, said stem portion having a flexibility which (1) allows oscillation of said impact mass relative to said armature during flight of said impact mass from a rest position to a point of impact with a print medium upon energization of said electromagnetic circuit and (2) maintains said impact mass coupled to said armature portion during pivotal movement of said armature portion and allows dynamic decoupling of said mass from said armature portion by abrupt stopping of said armature portion, said electromagnetic circuit including a stator member having an operating pole piece cooperable with said armature portion of said hammer element to form said operating air gap, and stop means for abruptly stopping said armature portion to dynamically decouple said impact mass at or near the point of impact with said print medium including a rigid spur extending from and movable with said armature portion of said hammer element, and a stationary stop member located in the path of movement of said spur, said stop member being positioned to engage said spur at a point which prevents crashing of said armature portion with said pole piece.

2. A print hammer device in accordance with claim 1 in which said stop means further comprises a stop pad on said stop member for engaging said spur on said armature portion, said stop pad having a visco-elasticity substantially matching the rebound characteristics of said print medium whereby said armature portion rebounds in time to prevent double impact by said impact mass with said print medium.

3. A print hammer device in accordance with claim 2 in which said stop pad is made of polyurethane.

* * * * *